US006030714A

United States Patent [19]

Fujibayashi et al.

[11] Patent Number: 6,030,714

[45] Date of Patent: Feb. 29, 2000

[54] ZINC AND ZINC-ALLOY HOT-DIP-COATED STEEL SHEET HAVING DECREASED BARE SPOTS AND EXCELLENT COATING ADHESION AND A METHOD FOR MANUFACTURING THE SAME

[75] Inventors: Nobue Fujibayashi; Kazuaki Kyono; Motonori Miyaoka, all of Okayama; Nobuo Totsuka, Kyoto, all of Japan

[73] Assignee: Kawasaki Steel Corporation, Hgoyo, Japan

[21] Appl. No.: 08/913,314

[22] PCT Filed: Jan. 13, 1997

[86] PCT No.: PCT/JP97/00045

§ 371 Date: Sep. 12, 1997

§ 102(e) Date: Sep. 12, 1997

[30] Foreign Application Priority Data

| | | | |
|---|---|---|---|
| Jul. 13, 1996 | [JP] | Japan | 8-199305 |
| Jul. 13, 1996 | [JP] | Japan | 8-199306 |
| Jul. 31, 1996 | [JP] | Japan | 8-243987 |
| Jul. 31, 1996 | [JP] | Japan | 8-243988 |

[51] Int. Cl.[7] ..... B32B 15/18; B05D 1/18; C23C 28/00; C21D 8/02

[52] U.S. Cl. ..... 428/659; 427/436; 427/431; 427/406; 148/276; 148/533; 148/601; 148/602

[58] Field of Search ..... 428/653, 659, 428/610, 647; 427/436, 431, 406; 148/276, 533, 601, 602

[56] References Cited

U.S. PATENT DOCUMENTS

| | | | |
|---|---|---|---|
| 4,722,871 | 2/1988 | Radtke | 428/653 |
| 4,847,169 | 7/1989 | Sakai et al. | 428/659 |
| 5,326,648 | 7/1994 | Kato et al. | 428/610 |
| 5,491,035 | 2/1996 | Carey, II et al. | 428/647 |

*Primary Examiner*—John J. Zimmerman
*Assistant Examiner*—Jason Resnick
*Attorney, Agent, or Firm*—Young & Thompson

[57] ABSTRACT

A zinc and zinc-alloy hot-dip-coated steel sheet and an alloyed zinc and zinc-alloy hot-dip-coated steel sheet, and a method for manufacturing these steel sheets, which steel sheets are used for automobiles. A zinc and zinc-alloy hot-dip-coated steel sheet which has oxides of readily oxidizable elements just under a coated layer and which shows a decreased number of bare spots and excellent coating adhesion. According to the method, the temperature for coiling during hot rolling is set to not less than 600° C. and the cooling is conducted at a slow-cooling rate so that the-oxides remain after the following steps.

10 Claims, 6 Drawing Sheets

10μm

10μm

ZINC AND ZINC-ALLOY HOT-DIP-COATED STEEL SHEET HAVING DECREASED BARE SPOTS AND EXCELLENT COATING ADHESION AND A METHOD FOR MANUFACTURING THE SAME

TECHNICAL FIELD

The present invention relates to a zinc and zinc-alloy hot-dip-coated steel sheet having a decreased number of bare spots and excellent coating adhesion, and a method for manufacturing the same.

BACKGROUND ART

Zinc and zinc-alloy hot-dip-coated steel sheets are mainly used for automobile bodies because of low cost and excellent corrosion resistance, and in addition to the corrosion resistance due to coating, coating adhesion during press working is required for applying the steel sheets to automobile bodies. When coating adhesion deteriorates, coated layers peel as a powder or blocks, which phenomenon sometimes causes galling in press forming or deteriorates corrosion resistance of the portions from which the coated layer peels; and also, peeled fragments disadvantageously inflict the steel sheet.

As a conventional technique for improving coating adhesion, Japanese Patent Laid-Open No. 61-276961 discloses a technique in which alloying Fe with Zn at a high temperature ranging from 700 to 850° C. is performed after zinc hot-dip-coating. However, alloying at a high temperature lead to not only higher costs but also increased expenses for equipment such as rolls.

Additionally, in Japanese Patent Laid-Open No. 3-232926, steel contains at least one of Zr, La, Ce, Y, and Ca, and the cooling rate from recrystallization annealing to coating is set to not less than 50° C./sec. The cost is raised due to the addition of Zr or the like to steel and productivity deteriorates because the sheet-feeding rate has to be lowered due to the cooling capacity.

Furthermore, in Japanese Patent Laid-Open No. 2-163356, the O, Al, and N contents in steel are set to not more than 0.0045 wt %, (25×N wt %) to 0.15 wt %, and not more than 0.0030%, respectively. Moreover, restrictions on the Ti, Si, and P contents, and Si (wt %)+P (wt %)≧Ti (wt %) must be satisfied according to Japanese Patent Laid-Open No. 6-81101. Anyway, the desired steel-sheet properties such as strength and drawing cannot be always achieved by such content restrictions, and there is a possibility that coating adhesion will deteriorate because of deviations from a predetermined composition range.

In Japanese Patent Laid-Open No. 4-333552, coating adhesion is improved by carrying out Ni pre-plating before galvanizing. However, in general, a continuous galvanizing line (hereinafter referred to as "CGL") does not have such equipment, and a large investment is required for improving equipment or the like.

Meanwhile, automobile bodies are required to be lighter because of recent regulations for exhaust gas. Thinning the steel sheets is a method for lightening the automobile bodies. According to this method, it is necessary for ensuring safety to increase steel-sheet strength corresponding to the decreased thickness. Thus, high tensile-strength steel sheets have been developed for strengthening the steel sheets by increasing the steel contents of elements such as Si, Mn, and P. Since steel sheets for automobiles are subjected to press forming, excellent material characteristics with a high r-value (high Lankford value) are required, and in particular, the addition of these elements is essential for high-tensile strength steel sheets.

In the case of zinc hot-dip-coating such steel sheets, recrystallization annealing at a high temperature ranging from approximately 700 to 900° C. is necessary to attain excellent material characteristics. In the CGL, recrystallization annealing is generally carried out under a nitrogen atmosphere in the presence of hydrogen (hereinafter referred to as reduction annealing), and although this atmosphere is a reducing atmosphere for Fe, it is an oxidizing atmosphere for some elements such as Si, Mn, and P. Thus, elements such as Si, Mn, and P (referred to as readily oxidizable elements) which are more oxidizable than Fe externally diffuse during reduction annealing and bond to oxygen on the surface of steel sheets to form oxides (called as "surface segregated layer"). Since these oxides significantly impede wettability between molten zinc and the steel sheets, so-called bare spots, i. e., defects occurring when zinc does not adhere to the steel sheets, are seen.

For overcoming such problems, Japanese Patent Examined Publication No. 61-9386 proposes a method of pre-plating the surface of steel sheets with Ni before the zinc hot-dip-coating process. However, according to this method, when steel contains at least Si and one more element among 0.2 to 2.0 wt % of Si, 0.5 to 2.0 wt % of Mn, and 0.1 to 20 wt % of Cr, Ni plating of not less than 10 g/m$^2$ is necessary, resulting in an increased cost. In addition, although such a large quantity of Ni plating improves the wettability between the zinc hot-dip-coating and the steel sheet, disadvantageously, defects caused by Si and Ni on the coated surface frequently appear during the alloying process.

Furthermore, for example, Japanese Patent Laid-Open No. 57-70268 proposes a method of pre-plating the surface of steel sheets with Fe before the zinc hot-dip-coating process. According to this method, bare spots in Si-containing steel are preventable by p-e-plating, however, not less than 5 g/m$^2$ of Fe plating is required, which fact is extremely uneconomical.

Additionally, other methods are disclosed in Japanese Patent Laid-Open Nos. 55-122865 and 4-254531. In these methods, steel sheets are oxidized beforehand to form a Fe oxide film on their surface and then subjected to reduction annealing. However, according to these methods, alloy elements such as Si are segregated on the surface to form an oxide film because of excess reducing during reduction annealing, causing a problem of inferior coating. For preventing such excess reducing, a large amount of Fe oxide is necessary. However, if the amount of Fe oxide film is exceedingly large, the Fe oxide film peels due to rolling or the like, thus on the contrary, a surface segregated layer is produced and results in impeded coating or adverse effects on operation because the fragments of the peeled Fe oxide-film are scattered inside a furnace.

In addition, concerning known proposals for the steel composition and hot-rolling conditions for zinc hot-dip-coating the high-tensile steel sheets, Japanese Patent Laid-Open No. 6-158172 discloses a method in which a steel containing Si≦0.2 and Mn≦1.5 by wt % is wound at a temperature not less than 650° C. followed by acid washing, cold-rolling, annealing, and zinc hot-dip-coating; and Japanese Patent Laid-Open No. 6-179943 discloses a method in which a steel containing 0.10 to 1.5 wt % of Si and 1.00 to 3.5 wt % of Mn is wound at a temperature ranging from 500° C. to 680° C., both inclusive, followed by acid washing, cold-rolling, annealing, and zinc hot-dip-coating.

Although these methods give specified processing conditions, such as the steel composition and hot-rolling conditions, for a series of manufacturing steps, they cannot suppress the surface segregated layer formed during reduction annealing or improve bare spots or coating adhesion.

DISCLOSURE OF THE INVENTION

As a result of detailed experiments, the inventors of the present invention have found that bare spots and coating adhesion are remarkably improved by providing oxides of readily oxidizable elements just under a coated layer of a zinc and zinc-alloy hot-dip-coated steel sheet.

In other words, the present invention provides a zinc and zinc-alloy hot-dip-coated steel sheet having oxides of readily oxidizable elements just under a coated layer.

Moreover, in the zinc and zinc-alloy hot-dip-coated steel sheet, the oxygen concentration is preferably not less than 1 ppm, more preferably, 2 to 200 ppm, and further more preferably, 3 to 100 ppm, in a region of from the surface layer of a steel-sheet substrate just under the coated layer to 3 $\mu$m deep in the sheet-thickness direction.

In addition, such hot-dip-coated steel sheets are preferably further subjected to heat-alloying after zinc hot-dip-coating, and excellent alloyed zinc and zinc-alloy hot-dip-coated steel sheets are thereby obtained. Also in the alloyed zinc and zinc-alloy hot-dip-coated steel sheets, the oxygen concentration is preferably not less than 1 ppm, more preferably, 2 to 200 ppm, and further more preferably, 3 to 100 ppm, in a region of from the surface layer of a steel-sheet substrate just under the coated layer to 3 $\mu$m deep in the sheet-thickness direction.

Furthermore, each of the zinc and zinc-alloy hot-dip-coated steel sheets and alloyed zinc and zinc-alloy hot-dip-coated steel sheets is preferably contains at least one element selected from the group consisting of Si, Mn, and P as a steel component in the following ranges:

$0.001 \leqq Si \leqq 3.0$ Wt %

$0.05 \leqq Mn \leqq 2.0$ Wt %

$0.005 \leqq P \leqq 0.2$ Wt %

Additionally, the present invention provides a method for producing the above-mentioned zinc and zinc-alloy hot-dip-coated steel sheets or the alloyed zinc-alloy hot-dip-coated steel sheets both of which show a decreased number of base spots and excellent coating adhesion. In other words, the present invention provides a method having:

a step A for forming oxides just under the scale, which oxides are formed from elements more oxidizable than iron, by setting a temperature of a steel strip to not less than 600° C. and setting the mean slow-cooling rate up to 540° C. to not more than $(CT-540)^{0.9} \div 40$ (° C./min) during coiling the steel strip hot-rolled; and a step B for zinc and zinc-alloy hot-dip-coating the steel strip. According to this method, the step B follows the step A, and other steps may be also employed between the steps A and B. In general, steps of pickling, degreasing, cold rolling, annealing, and the like may appropriately be used as such intermediate steps.

In addition, according to a method of the present invention, the oxides formed in the step A preferably remain after a pre-treatment step carried out after the step A until treatment conducted in an annealing furnace immediately before the step B.

Furthermore, according to these methods, a slab subjected to hot rolling preferably contains at least one element selected from the group consisting of Si, Mn, and P as a steel component in the following ranges:

$0.001 \leqq Si \leqq 3.0$ Wt %

$0.05 \leqq Mn \leqq 2.0$ Wt %

$0.005 \leqq P \leqq 0.2$ Wt %

Moreover, according to any of the above-mentioned methods, an alloyed zinc and zinc-alloy hot-dip-coated steel sheet can be produced by employing heat-alloying treatment after the step B.

Next, oxides of readily oxidizable elements positioned just under a coated layer will be explained.

These oxides of readily oxidizable elements are formed during hot-rolling, in particular, the oxides are grown when the temperature (hereinafter referred to as "CT") during coiling is high and the cooling rate after coiling is low.

The oxides formed during hot-rolling are observed just under the scale, as is shown in FIG. 6. Meanwhile, in a conventional hot-rolled sheet, no oxide is observed just under the scale, as is shown in FIG. 7. The oxides observed during hot-rolling are analyzed by using an electron probe microanalyzer (hereinafter referred to as "EPMA") and the results are shown in FIG. 1. Since Mn, P, Al, and O show peaks, it is understood that oxides of these elements are formed. Steel sheets shown in FIGS. 6 and 1 contain 0.1 wt % of Mn, 0.006 wt % of P, and 0.03 wt % of Al, and they do not contain a particularly large amount of Mn, P, or Al.

The oxides positioned just under a coated layer of a zinc hot-dip-coated steel sheet or an alloyed zinc hot-dip-coated steel sheet of the present invention are produced such that oxides formed just under the scale during the hot-rolling process remain even after post-treatment steps such as pickling and coating.

The mechanism of producing oxides just under the scale is as follows: oxygen in a scale layer essentially consisting of iron oxide which has been formed during hot-rolling internally diffuses into steel during or after the coiling process, and then, forms an oxide of a readily oxidizable element in the steel. Therefore, oxides are produced even when only a trace amount of readily oxidizable elements is contained in the steel.

Although oxides of elements more oxidizable than iron exist just under the zinc and zinc-alloy hot-dip-coating according to the present invention, an oxide of an element less oxidizable than iron oxide or iron may also be contained. In addition, such an oxide is preferably formed in grain boundaries of a hot-rolled steel sheet.

As a result of studies and investigations conducted on various types of steel sheets, the inventors of the present invention have found oxides of Si—O, Mn—O, Al—O, P—O, and Fe—Si—O in the steel sheets.

FIG. 2 shows the result of elemental analysis of a conventional steel sheet and FIG. 3 shows that of an unannealed cold-rolled steel sheet wherein oxides were observed, which analysis was carried out in a region of from the surface of each steel sheet to approximately 10 $\mu$m in the depth direction by glow-discharge spectroscopy (hereinafter referred to as "GDS"). The peaks of Mn, Al, P, and O observed at the depth of approximately 0.3 to 4 $\mu$m from the surface layer correspond to the oxides.

FIG. 4 shows the result of elemental analysis of a conventional steel sheet and FIG. 5 shows that of an annealed cold-rolled steel sheet wherein oxides were observed, which analysis was carried out by GDS in a region of from the surface of each steel sheet to approximately 10 $\mu$m in the depth direction. A large amount of surface segregated substances generated by reduction annealing is observed in the conventional steel sheet of FIG. 4, meanwhile the generation of surface segregation products is suppressed and hardly observed in the steel sheet with oxides produced during hot-rolling.

Next, oxides of the present invention which exist in a surface layer of a steel sheet (surface layer of a steel-sheet substrate) just under a coated layer can optical-microscopically be observed by etching the steel sheet with a 1% nital solution for several to several dozen of seconds.

FIG. 8 (photograph) and FIG. 9 (photograph) show a conventional alloyed zinc hot-dip-coated steel sheet not containing oxide and an alloyed zinc hot-dip-coated steel sheet containing oxides incorporated in the present invention, respectively. FIGS. 8 and 9 are cross-sectional optical micrographs of alloyed zinc hot-dip-coated steel sheets taken at a magnification of ×1,000. Black ribbon-like materials observed just under the coated layer are oxides (shown by arrows).

In addition, the formation of oxides can also be confirmed by analyzing oxygen contained in steel. Concerning technique, oxygen in steel is analyzed in the total sheet-thickness direction using a hot-rolled steel sheet whose scale layer has been removed by pickling after coiling, a steel sheet obtained by dissolving only a coated layer of a zinc and zinc-alloy hot-dip-coated steel sheet, an unannealed cold-rolled steel sheet, or an annealed steel sheet, and the resulting values are compared with those of steel sheets obtained by grinding the surface layer in which oxides are formed. The steel sheets in which oxides are formed have larger oxygen values analyzed in the total sheet-thickness direction as compared with those of the ground sheets.

Next, the mechanism of improving bare spots and coating adhesion by forming oxides just under a coated layer will be investigated.

First, concerning improvement in bare spots, it was found that surface segregation of readily oxidizable elements is suppressed during reduction annealing in the CGL when oxides a-re produced just under the scale by internal oxygen diffusion during or after coiling, as is above-mentioned.

This phenomenon is assumed to be due to following: the amount of readily oxidizable elements in the surface layer decreases because the readily oxidizable elements already precipitate as oxides during or after coiling; the formed oxides impede transfer (external diffusion) of the readily oxidizable elements from bulk steel to the steel sheet surface; and oxidation-reduction occurs inside the steel sheet, in other words, a Fe-containing oxide produced during or after coiling changes to an oxide of readily oxidizable element during reduction annealing.

Therefore, the surface segregated substances of the readily oxidizable elements, which substances impede wettability between molten zinc and the steel sheet, extremely decrease, thereby remarkably improving bare spots.

Next, coating adhesion will be explained.

It has been known that coating peels mainly due to compressive stress during press forming.

Since a steel sheet having oxides just under a coated layer, i. e. a steel sheet of the present invention, has spaces between oxide crystals, zinc more readily penetrates into the steel sheet as compared with conventional steel sheets not containing oxides. As a result, the interface between the coated layer and the steel sheet is significantly roughened so that the coated layer can tightly adhere to the steel sheet. As a result, a zinc hot-dip-coated steel sheet and an alloyed zinc hot-dip-coated steel sheet both incorporated in the present invention acquire excellent coating adhesion during press forming.

FIGS. 10 and 11 show the observation results obtained from a steel sheet using a SEM, a coated layer of which steel sheet has been forcibly dissolved to the iron potential according to a galvanostatic process (4% methyl salicylate, 1% salicylic acid, and 10% potassium iodide/methanol solution; 5 mA/cm$^2$) so as to expose the steel sheet. It is understood that the interface between the coated layer and the steel sheet is apparently more roughened as compared with the conventional steel sheet not containing oxides.

In addition, the technique disclosed by the present invention exhibits more excellent effects when a steel sheet contains at least one component selected from the group consisting of Si, Mn, and P as a steel component in the following ranges:

$0.001 \leqq Si \leqq 3.0$ Wt %

$0.05 \leqq Mn \leqq 2.0$ Wt %

$0.005 \leqq P \leqq 0.2$ Wt %

Problems such as bare spots and decreased coating adhesion hardly occur in steel sheets not containing the above elements, thus the lower limits for these elements are preferably 0.001 wt % for Si, 0.05 wt % for Mn, and 0.005 wt % for P. Meanwhile, the upper limit for each element is determined considering the preferable ranges for both the maximum effect for strengthening and cost.

Furthermore, the technique disclosed by the present invention exhibits sufficient effects on both bare spots and coating adhesion when even a small amount of oxides is observed by an optical microscope in a cross-section of a zinc and zinc-alloy hot-dip-coated steel sheet etched by 1% nital.

In addition, according to an oxygen analysis of steel, sufficient effects are shown, particularly on bare spots and coating adhesion when the value of the following formula is not less than 1 ppm:

(oxygen in a steel sheet whose coating has been removed by a hydrochloric acid-antimony method)−(oxygen in a steel sheet whose coating has been removed by a hydrochloric acid-antimony method and whose surface layer is then ground to remove 3 $\mu$m thereof)

Next, a technique for manufacturing the above-described coated steel sheets will be disclosed. It is required that the temperature for coiling after hot-rolling be high and cooling after the coiling be slow, and a detailed explanation will be given below.

The temperature for coiling after hot-rolling must be 600° C. or more to produce oxides and the cooling rate up to 540° C. after coiling must be not more than the following:

$$(CT-540)^{0.9} \div 40 \ (^\circ \text{ C./min})$$

Oxides are not formed at not more than 540° C. even when slow-cooling is further carried out.

In addition, although pickling and/or grinding is generally carried out to remove the scale before coating, and sometimes, equipment for electrolytic degreasing or pickling is also provided for the CGL inlet side, the oxides produced in the surface layer of a steel sheet during or after coiling in the hot-rolling process must remain after the above treatment.

Zinc and zinc-alloy hot-dip-coating of the present invention is a general term for molten zinc containing zinc and may include not only zinc hot-dip-coating but also galfan and galvalume, in both of which Si is contained in zinc. Moreover, Pb, Mg, Mn, etc. may be further contained. Therefore, conditions for a zinc bath are not particularly restricted.

Other conditions for the coated layer are not particularly limited, however, considering corrosion resistance and the like, the preferred amount of zinc and zinc-alloy coating is approximately 25 to 90 g/m$^2$ and the preferred iron content in a coated layer in an alloyed zinc hot-dip-coated steel sheet is 8 to 13 wt %.

Furthermore, both hot-rolled steel sheets and cold-rolled steel sheets can be used as a material for coating.

REFERENCE NUMERALS

Figure 1:
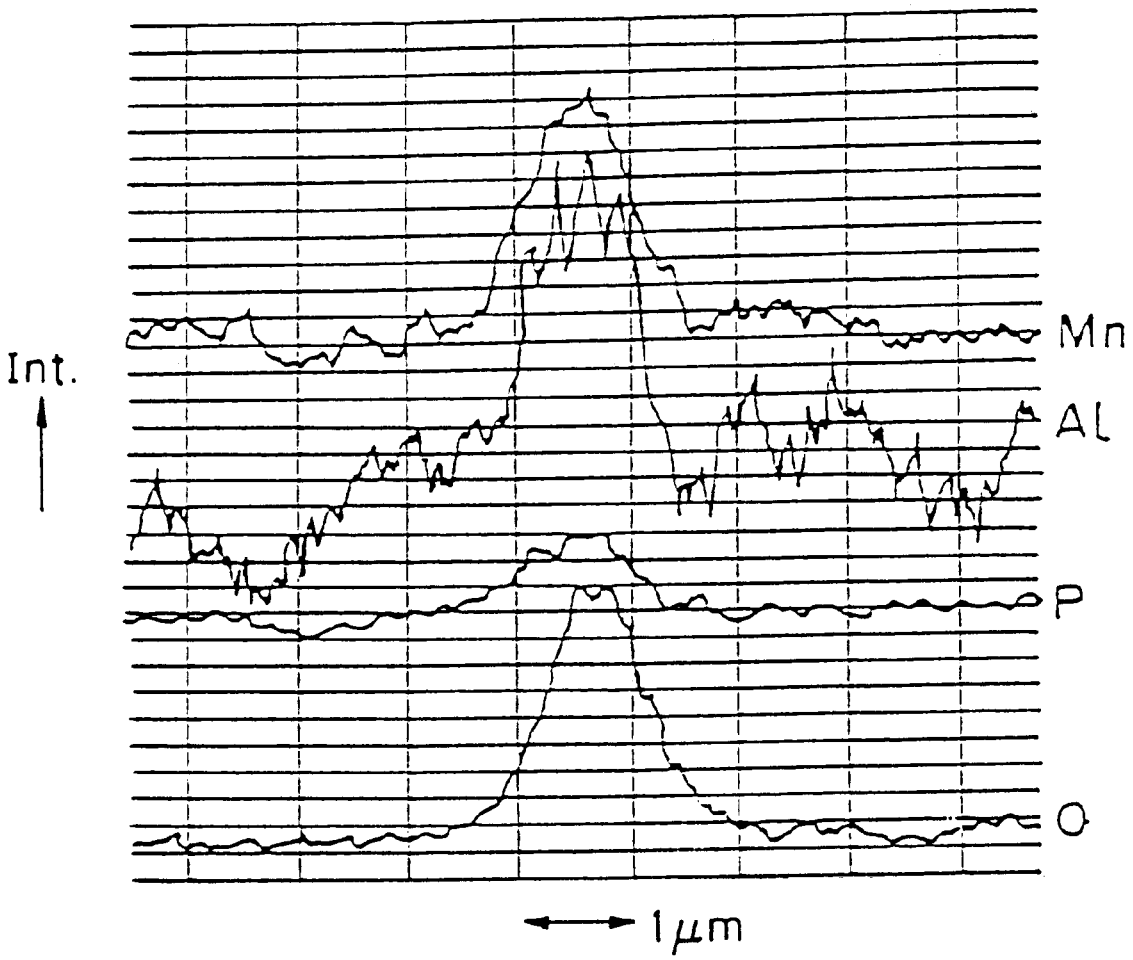
FIG. 1 An EPMA analysis chart of oxides observed just under the scale during hot-rolling.
Figure 2:
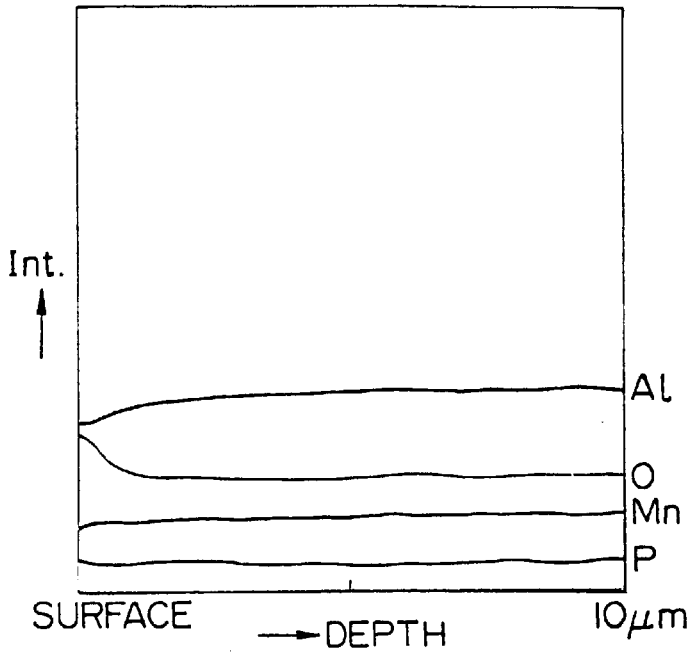
FIG. 2 A graph showing the result of elemental analysis of a conventional unannealed cold-rolled steel sheet, which analysis was carried out by GDS from the surface to approximately 10 μm in the depth direction.
Figure 3:
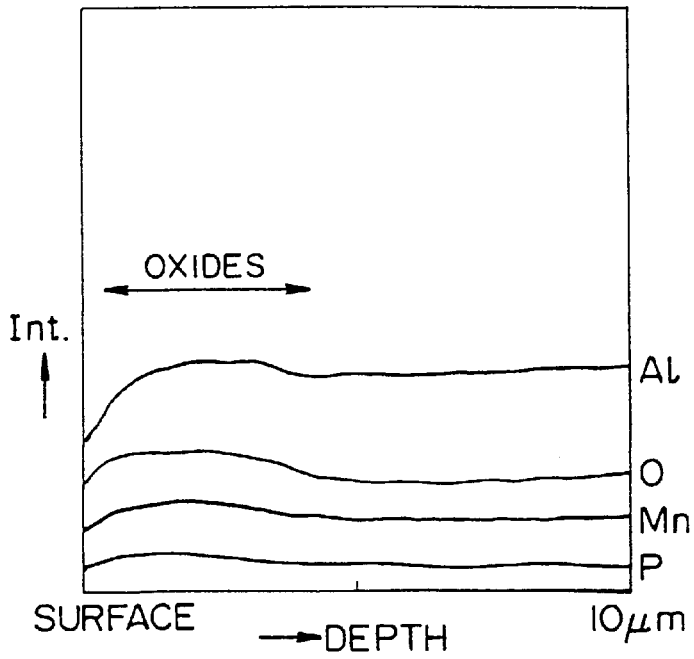
FIG. 3 A graph showing the result of elemental analysis of an unannealed cold-rolled steel sheet of the present invention, which analysis was carried out by GDS from the surface to approximately 10 μm in the depth direction.
Figure 4:
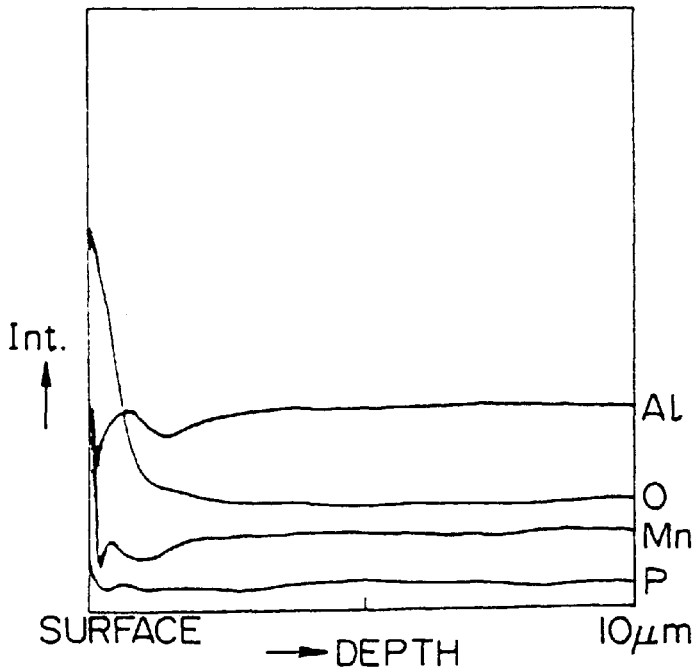
FIG. 4 A graph showing the result of elemental analysis of a conventional annealed cold-rolled steel sheet, which analysis was carried out by GDS from the surface to approximately 10 μm in the depth direction.
Figure 5:
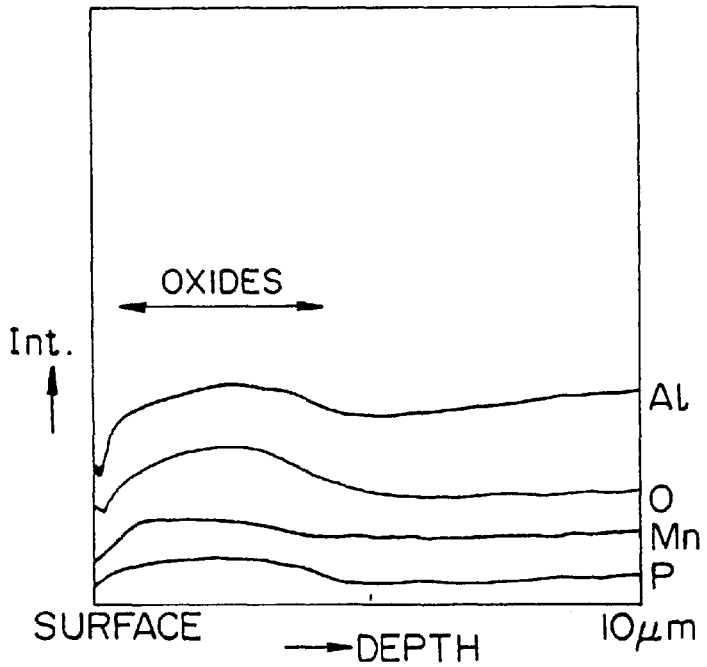
FIG. 5 A graph showing the result of elemental analysis of an annealed cold-rolled steel sheet of the present invention, which analysis was carried out by GDS from the surface to approximately 10 μm in the depth direction.
Figure 6:
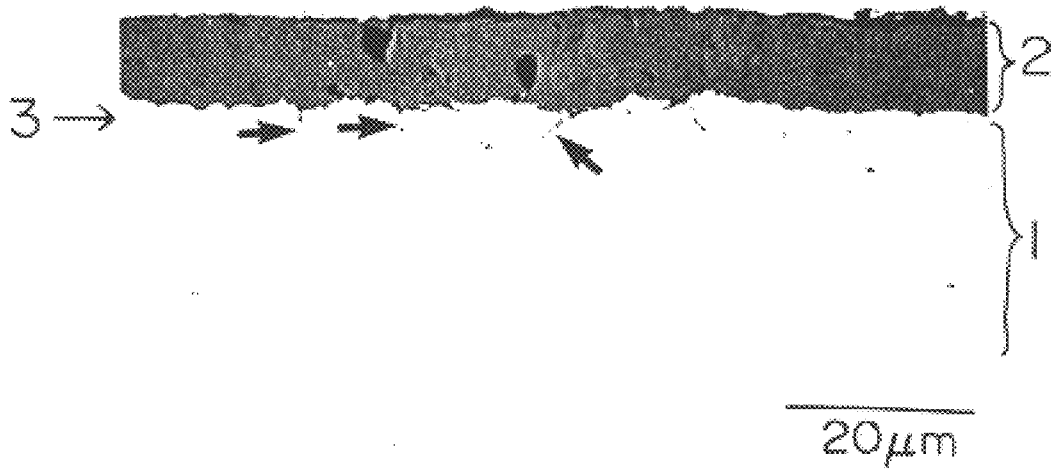
FIG. 6 A cross-sectional optical micrograph, taken at a magnification of ×1,000 showing oxides positioned just under the scale of a hot-rolled sheet of an example.
Figure 7:
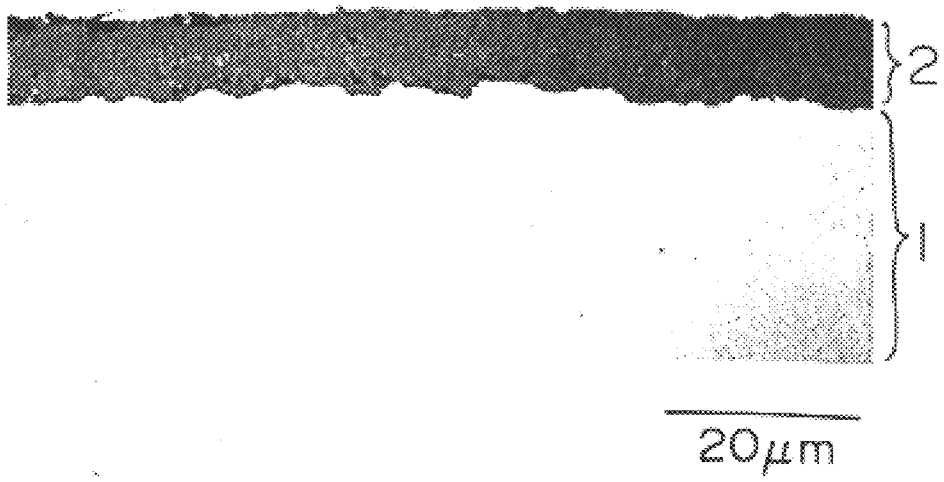
FIG. 7 A cross-sectional optical micrograph, taken at a magnification of ×1,000, showing oxides positioned just under the scale of a conventional hot-rolled sheet.
Figure 8:
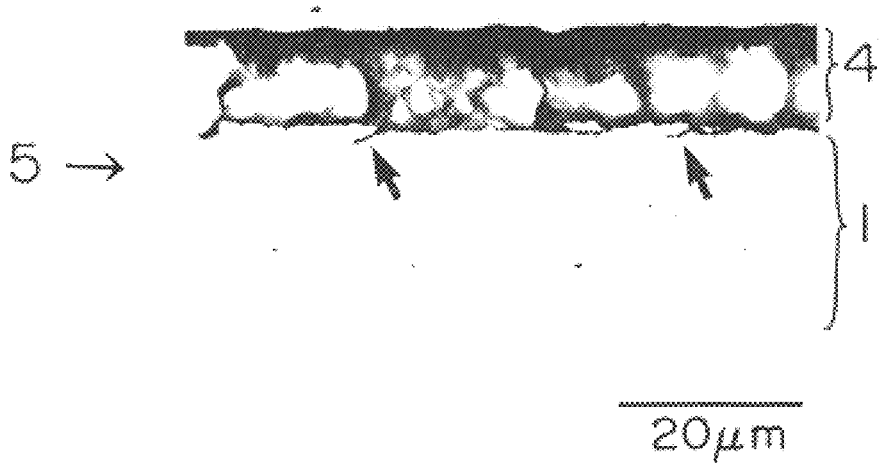
FIG. 8 A cross-sectional optical micrograph, taken at a magnification of ×1,000, showing an example alloyed zinc hot-dip-coated steel sheet containing oxides.
Figure 9:
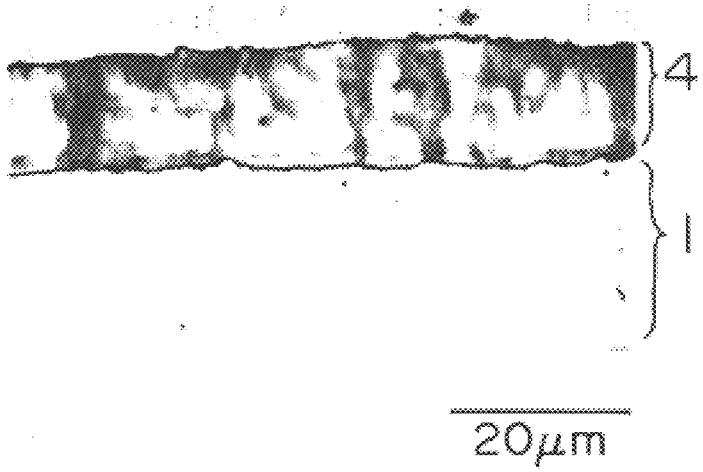
FIG. 9 A cross-sectional optical micrograph, taken at a magnification of ×1,000, showing a conventional alloyed zinc hot-dip-coated steel sheet not containing oxides.
Figure 10:
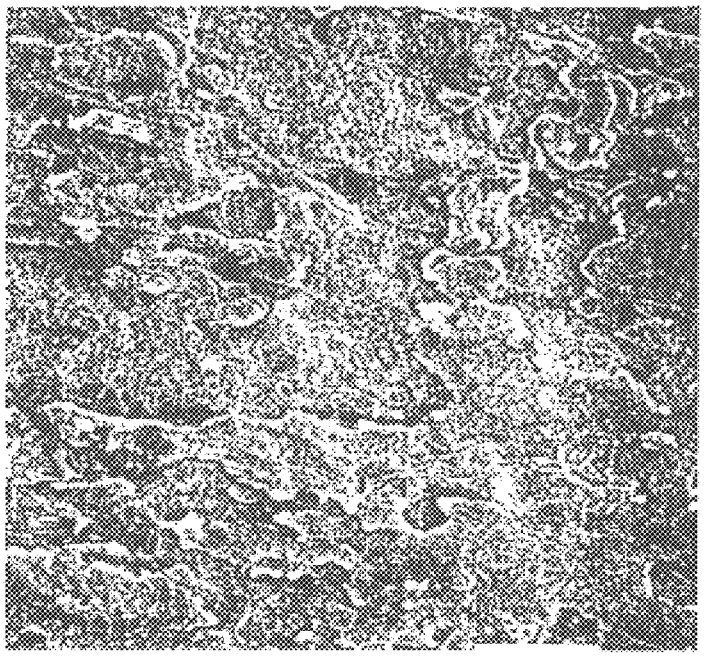
FIG. 10 A SEM photograph, taken at a magnification of ×1,500, showing an example steel sheet whose coated layer has been dissolved.
Figure 11:
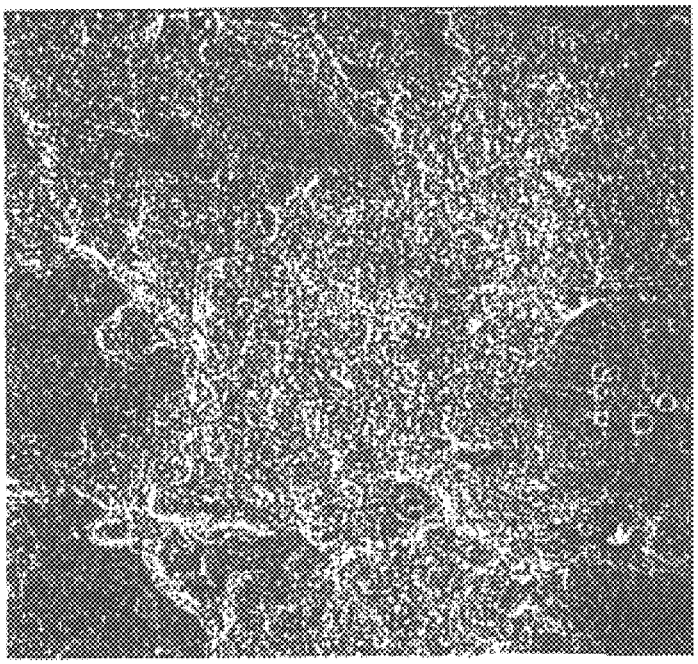
FIG. 11 A SEM photograph, taken at a magnification of ×1,500, showing a conventional steel sheet whose coated layer has been dissolved.

1, untreated steel-sheet portion; 2, scale; 3, oxides; 4, a coated layer; and 5, oxides.

BEST MODE FOR CARRYING OUT THE INVENTION

An example of the present invention will be shown below:

Each sample shown in Table 1 was melted by a converter and formed into a slab by continuous casting. Each of the resulting slabs was hot-rolled to 1.2 to 3.5 mm thick at a slab-heating temperature of 1150 to 1200° C., and with a finishing temperature of 900 to 920° C., and a coiling temperature and a cooling rate which are shown in Table 2. After that, the resulting sheets were pickled for 5 to 15 seconds at 80° C. in an aqueous 5% HCl solution to remove scale layers, and then, divided into two groups one of which was directly subjected to the CGL and the other was cold-rolled into 0.7 mm thick. Furthermore, in the CGL inlet side, the following methods were also used in combination as a pre-treatment for removing the surface layer of a steel sheet, if required.

Electrolytic degreasing: electrolysis at 60° C. in an aqueous 3% NaOH solution for approximately 10 seconds.

Pickling: pickling at 60° C. in an aqueous 5% HCl solution for approximately 3 seconds.

Brushing roll: a brushing roll with abrasive grains.

In the CGL, both the hot-rolled sheet and the cold-rolled sheet were zinc hot-dip-coated at 470° C. after annealing at 800 to 850° C. In addition, alloyed zinc hot-dip-coated steel sheets were obtained by successively subjecting the annealed sheets to an alloying process conducted at 480 to 530° C. for 15 to 30 seconds.

Evaluation Method for Oxide

Observation Method for Oxides in Hot-rolled Sheets

A cross section of each hot-rolled sheet with the scale was ground and, without being etched, subjected to optical-microscopic observation so as to measure the depth of oxide invasion. The preferred magnification of the optical microscopy was 1,000.

Quantitative Evaluation of Oxides in Hot-rolled Sheets

The following value was obtained:

(oxygen in steel analyzed in the total sheet-thickness direction of a hot-rolled sheet whose scale has been removed by pickling)−(oxygen in steel of a steel sheet which has been ground to reach the depth of oxide invention in the sheet-thickness direction after removing the scale)

Quantitative Evaluation of Oxides in Coated Sheets

Each of the coated sheets was immersed in the solutions shown below until the end of the dissolving reaction of coating and then the concentration of the oxide-derived oxygen in a region of from the surface of the steel sheet to 3 μm in the sheet-thickness direction was calculated according to the following formula:

(oxygen in a steel sheet whose coating was peeled by a hydrochloric acid-antimony method)−(oxygen in a steel sheet whose coating was peeled by a hydrochloric acid-antimony method and whose surface layer was then ground to remove 3 μm thereof)

1% nital solution 1 vol % $HNO_3$-ethanol solution hydrochloric acid-antimony method $Sb_2O_3$ (20 g)+35% HCl (1 1)

Evaluation Method for Bare-spots

Each of the coated sheets was evaluated by macroscopic observation.

Bare spots not observed: rank 1
a few were observed: rank 2
a small number were observed: rank 3
observed: rank 4

Test for Coating-adhesion Evaluation

Each of the coated sheets was subjected to a Dupont impact test using a ½-inch punch and occurrence of peeling was confirmed by macroscopic observation.

Peeling was not observed: o

Peeling was observed: x

Each alloyed zinc alloy hot-dip-coated steel sheet was bent to 90°, bent back, and then the compressed side of the steel sheet was peeled by a tape so as to measure the peeled amount of zinc by fluorescent X ray.

Count number of: less than 500: rank 1 (good)
not less than 500 to less than 1,000: rank 2
not less than 1,000 to less than 2,000: rank 3
not less than 2,000 to less than 3,000: rank 4
not less than 3,000: rank 5

Table 3 shows the results of the zinc hot-dip-coated steel sheet and Table 4 shows those of the alloyed zinc hot-dip-coated steel sheets.

TABLE 1

Sample-Steel Composition

| Symbol | C wt % | Si wt % | Mn wt % | P wt % |
|---|---|---|---|---|
| A | 0.105 | 0.010 | 0.08 | 0.008 |
| B | 0.070 | 0.10 | 0.10 | 0.01 |
| C | 0.070 | 0.50 | 2.0 | 0.07 |
| D | 0.010 | 1.50 | 0.10 | 0.05 |
| E | 0.003 | 0.003 | 0.05 | 0.005 |
| F | 0.003 | 0.01 | 0.20 | 0.01 |
| G | 0.003 | 0.30 | 0.50 | 0.04 |
| H | 0.003 | 0.05 | 1.95 | 0.20 |

TABLE 2

Coiling conditions, depth of oxide invasion into hot-rolled sheet, and oxide amount in hot-rolled sheet

| Sample steel | CT ° C. | Mean cooling rate to 540° C. ° C./min | Depth of oxide invasion into hot-rolled sheet μm | Oxide amount in hot-rolled sheet ppm | Sample steel No. |
|---|---|---|---|---|---|
| A | 540 | 1.0 | 0 | 0 | 1 |
| A | 600 | 1.0 | 1 | 1 | 2 |
| A | 600 | 1.5 | 0 | <1 | 3 |
| A | 700 | 2.0 | 7 | 5 | 4 |
| B | 650 | 1.5 | 8 | 8 | 5 |
| C | 650 | 1.5 | 6 | 7 | 6 |
| D | 580 | 1.0 | 0 | 0 | 7 |
| D | 620 | 1.2 | <1 | <1 | 8 |
| E | 650 | 1.2 | 5 | 5 | 9 |
| E | 650 | 1.6 | <1 | 1 | 10 |
| E | 650 | 1.8 | 0 | <1 | 11 |
| F | 650 | 1.0 | 10 | 11 | 12 |
| G | 650 | 1.0 | 12 | 15 | 13 |
| H | 600 | 1.8 | 0 | 0 | 14 |
| H | 650 | 1.0 | 12 | 18 | 15 |

TABLE 3

Examples and Comparative Examples (Zinc hot dip coated steel sheets)

| Example and comparative example | Corresponding sample steel No. in Table 2 | Oxide by hot rolling | Cold rolling | Surface removal by pretreatment in CGL inlet side $g/m^2$ | Plating amount $g/m^2$ | Oxide amount in plated sheet ppm | Bare-spot rank | Dupont test result |
|---|---|---|---|---|---|---|---|---|
| Comparative example 1 | 1 | not observed | none | <0.1 | 40 | 0 | 1 | x |
| Example 1 | 2 | observed | done | <0.1 | 50 | 1 | 1 | ○ |
| Example 2 | 2 | observed | not done | <0.1 | 50 | 1 | 1 | ○ |
| Example 3 | 4 | observed | done | 0.5 | 70 | 5 | 1 | ○ |
| Comparative example 2 | 4 | observed | done | 8.0 | 70 | 0 | 4 | x |
| Example 4 | 4 | observed | not done | 0.5 | 70 | 3 | 1 | ○ |
| Example 5 | 5 | observed | done | 0.1 | 60 | 7 | 1 | ○ |
| Example 6 | 6 | observed | done | 3.5 | 60 | 2 | 1 | ○ |
| Comparative example 3 | 7 | not observed | done | 0.1 | 50 | 0 | 1 | x |
| Example 7 | 8 | observed | done | <0.1 | 90 | <1 | 1 | ○ |
| Example 8 | 9 | observed | done | 0.5 | 50 | 5 | 1 | ○ |
| Example 9 | 10 | observed | done | 0.3 | 40 | 1 | 1 | ○ |
| Comparative example 4 | 10 | observed | done | 1.0 | 40 | 0 | 3 | x |
| Example 10 | 12 | observed | done | 0.2 | 50 | 10 | 1 | ○ |
| Example 11 | 13 | observed | done | 0.2 | 50 | 11 | 1 | ○ |
| Comparative example 5 | 14 | not observed | done | 0.2 | 50 | 0 | 4 | x |
| Example 12 | 15 | observed | done | 0.2 | 50 | 16 | 1 | ○ |

TABLE 4

Examples and Comparative Examples (alloyed zinc hot dip coated steel sheets)

| Example and comparative example | Correspond-ing sample steel No. in Table 2 | Oxide by hot rolling | Cold rolling | Surface removal by pretreatment in CGL inlet side $g/m^2$ | Plating amount $g/m^2$ | Fe content in plating % | Oxide amount in plated sheet ppm | Bare-spot rank | Powdering test result |
|---|---|---|---|---|---|---|---|---|---|
| Comparative example 1 | 1 | not observed | done | 0.1 | 40 | 10.5 | 0 | 1 | 4 |
| Example 1 | 2 | observed | done | 0.1 | 40 | 10.3 | 1 | 1 | 1 |
| Example 2 | 4 | observed | done | 0.5 | 40 | 11.4 | 3 | 1 | 1 |
| Example 3 | 6 | observed | done | 0.2 | 70 | 9.6 | 6 | 1 | 2 |
| Example 4 | 6 | observed | not done | 0.2 | 70 | 9.1 | 5 | 1 | 2 |
| Example 5 | 6 | observed | done | <0.1 | 30 | 10.1 | 7 | 1 | 1 |
| Comparative example 2 | 7 | not observed | not done | 0.1 | 60 | 11.5 | 0 | 2 | 5 |
| Example 6 | 8 | observed | done | 0.1 | 60 | 11.0 | <1 | 1 | 2 |
| Example 7 | 10 | observed | not done | <0.1 | 40 | 9.9 | 1 | 1 | 1 |
| Example 8 | 10 | observed | not done | 1.0 | 40 | 10.8 | <1 | 1 | 2 |
| Comparative example 3 | 10 | observed | not done | 3.0 | 40 | 9.0 | 0 | 1 | 3 |
| Example 9 | 13 | observed | done | 0.2 | 60 | 10.1 | 14 | 1 | 2 |
| Example 10 | 13 | observed | done | 5.0 | 60 | 10.5 | 5 | 1 | 2 |
| Example 11 | 13 | observed | done | 15.0 | 60 | 9.2 | 2 | 1 | 1 |
| Comparative example 4 | 13 | observed | done | 25.0 | 60 | 10.5 | 0 | 3 | 4 |
| Comparative example 5 | 14 | not observed | done | 1.0 | 40 | 11.8 | 0 | 3 | 5 |
| Example 12 | 15 | observed | done | 0.2 | 30 | 11.1 | 15 | 1 | 1 |
| Example 13 | 15 | observed | done | 0.2 | 60 | 10.4 | 15 | 1 | 2 |

Industrial availability

The technique disclosed by the present invention relates to a zinc hot-dip-coated steel sheet and an alloyed zinc hot-dip-coated steel sheet showing a decreased number of bare spots and excellent coating adhesion, and are appropriately used mainly for steel sheets of automobile bodies.

We claim:

1. A zinc and zinc-alloy hot-dip-coated steel sheet comprising oxides inside of and near the surface of the steel sheet substrate just under a coated layer, said oxides being formed with elements more oxidizable than iron.

2. A zinc and zinc-alloy hot-dip coated steel sheet comprising oxides just under a coated layer, said oxides being formed with elements more oxidizable than iron, wherein the oxygen concentration is not less than 1 ppm in a region of from the surface layer of a steel sheet substrate just under said coated layer to 3 $\mu$m deep in the sheet-thickness direction.

3. The zinc and zinc-alloy hot-dip-coated steel sheet as set forth in claim 1, wherein said steel sheet is further subjected to heat-alloying.

4. The zinc and zinc-alloy hot-dip-coated steel sheet as set forth in claim 3, wherein the oxygen concentration is not less than 1 ppm in a region of from the surface layer of a steel-sheet substrate just under said coated layer to 3 $\mu$m deep in the sheet-thickness direction.

5. The zinc and zinc-alloy hot-dip-coated steel sheet as set forth in claim 1, wherein at least one element selected from the group consisting of Si, Mn, and P is contained as a steel component in the following ranges:

$0.001 \leqq Si \leqq 3.0$ Wt %

$0.05 \leqq Mn \leqq 2.0$ Wt %

$0.005 \leqq P \leqq 0.2$ Wt %.

6. A method for producing a zinc and zinc-alloy hot-dip-coated steel sheet comprising:

a step A for forming oxides just under a scale, which oxides are formed from elements more oxidizable than iron, by setting a temperature of a steel strip to not less than 600° C. and setting the mean slow-cooling rate up to 540° C. to not more than $(CT-540)^{0.9} \div 40$ (° C./min) during coiling said steel strip hot-rolled; and a step B for zinc and zinc-alloy hot-dip-coating said steel strip.

7. The method for producing a zinc and zinc-alloy hot-dip-coated steel sheet as set forth in claim 6, wherein said oxides formed in said step A remain after a pre-treatment step carried out after said step A and until annealing treatment is conducted in a furnace immediately before said step B.

8. The method for producing a zinc and zinc-alloy hot-dip-coated steel sheet as set forth in claim 6, wherein a slab subjected to hot rolling contains at least one element selected from the group consisting of Si, Mn, and P as a steel component in the following ranges:

$0.001 \leqq Si \leqq 3.0$ Wt %

$0.05 \leqq Mn \leqq 2.0$ Wt %

$0.005 \leqq P \leqq 0.2$ Wt %.

9. The method for producing a zinc and zinc-alloy hot-dip-coated steel sheet as set forth in claim 6, wherein said zinc and zinc-alloy hot-dip-coated steel sheet is treated with heat-alloying after said step B.

10. The method for producing a zinc and zinc-alloy hot-dip-coated steel sheet as set forth in claim 9, wherein a slab subjected to hot rolling contains at least one element selected from the group consisting of Si, Mn, and P as a steel component in the following ranges:

$0.001 \leqq Si \leqq 3.0$ Wt %

$0.05 \leqq Mn \leqq 2.0$ Wt %

$0.005 \leqq P \leqq 0.2$ Wt %.

* * * * *